United States Patent [19]

Hasegawa et al.

[11] Patent Number: 4,566,643

[45] Date of Patent: Jan. 28, 1986

[54] YARN FEEDING MEANS AND A YARN WINDER INCLUDING THE SAME

[75] Inventors: Katsumi Hasegawa; Hiromitsu Kanamori, both of Kusatsu, Japan

[73] Assignee: Toray Industries, Inc., Tokyo, Japan

[21] Appl. No.: 606,180

[22] Filed: May 2, 1984

[30] Foreign Application Priority Data

May 2, 1983 [JP] Japan ..... 58-76283

[51] Int. Cl.[4] ..... B65H 54/02

[52] U.S. Cl. ..... 242/18 R; 226/91; 226/154; 242/18 PW; 242/47.01

[58] Field of Search ..... 242/18 R, 18 PW, 18 A, 242/18 DD, 35.5 R, 45, 47.01, 47.08, 47.09; 226/91, 168, 154

[56] References Cited

U.S. PATENT DOCUMENTS

| | | | |
|---|---|---|---|
| 2,160,495 | 5/1939 | Francis | 242/45 |
| 3,559,903 | 2/1971 | McDermott et al. | 242/18 PW |
| 3,831,873 | 8/1974 | Bense | 242/47.09 X |
| 4,023,741 | 5/1977 | Schar | 242/18 PW X |
| 4,083,505 | 4/1978 | Burkhardt | 242/18 PW |
| 4,099,679 | 7/1978 | De Baker et al. | 242/18 PW |
| 4,164,330 | 8/1979 | Maassen et al. | 242/18 PW |
| 4,351,492 | 9/1982 | Aoyama et al. | 242/18 R |
| 4,477,032 | 10/1984 | Pfyffer et al. | 242/18 PW |

*Primary Examiner*—Stanley N. Gilreath
*Attorney, Agent, or Firm*—Austin R. Miller

[57] ABSTRACT

A yarn feeding means comprising a yarn detaching guide positioned in the vicinity of a positively rotating roller for feeding a yarn continuously fed from a supply source to a yarn winder and capable of selectively occupying either of two positions, one of which is a retractive position where the detaching guide is non-operative to the yarn path and the other is a projective position where the detaching guide is engageable with the yarn path to detach the yarn from the positively rotating roller. The yarn detaching guide holds the yarn during the threading operation away from the feed roller whereby the yarn can be withdrawn even by a standard capacity suction gun irrespective of a high surface speed of the feed roller. A winder comprising the yarn detaching guide is also provided.

12 Claims, 29 Drawing Figures

15
13
12
7
6
14a
Y
9
8
11
3
5
4

Fig. 13A
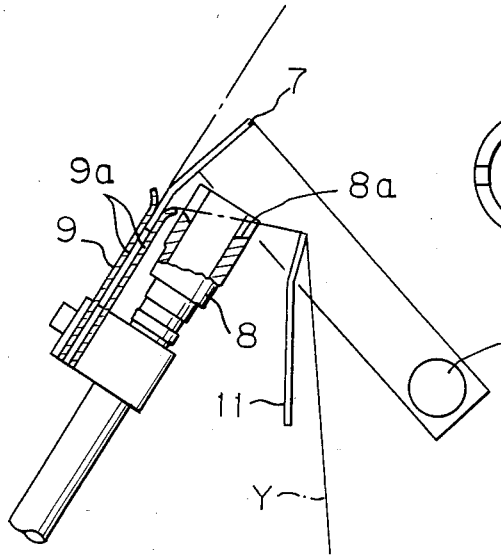
Fig. 13B
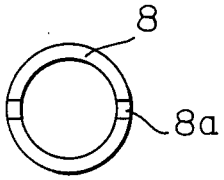
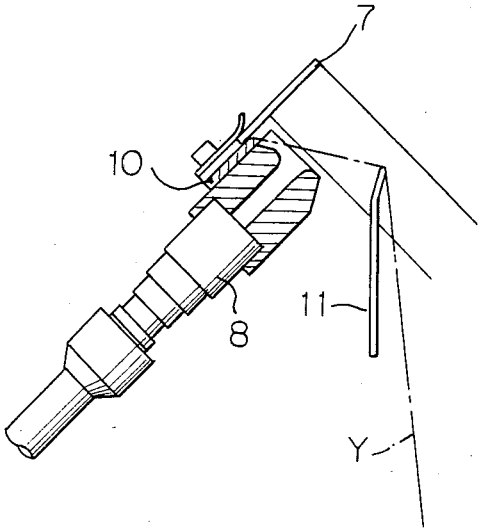
Fig. 14

YARN FEEDING MEANS AND A YARN WINDER INCLUDING THE SAME

BACKGRUUND OF THE INVENTION

1. Field of the Invention

The present invention relates to a yarn feeding means and a yarn winder including the yarn feeding means, especially a yarn feeding means for a synthetic filamentary yarn continuously extruded from a spinneret at a high speed.

2. Description of the Prior Art

Generally, a synthetic yarn is produced by extruding a polymer such as polyamide or polyester in a molten state from a spinneret to form continuous filaments. The filaments are then withdrawn by a yarn winder while passing through a yarn feeding means comprising at least one positively rotating roller.

When the yarn is newly extruded to the yarn winder, a threading operation is necessary for bringing the yarn spun from the spinneret to a yarn path while sequentially engaging the yarn with the positively rotating rollers and yarn guides. An air ejector (usually called a suction nozzle or gun) is often employed for this threading operation. The running yarn continuously extruded from the spinneret is sucked and withdrawn by the suction nozzle, and then threaded from the spinneret to the yarn winder by an operator moving the suction nozzle along the yarn path. The yarn feeding means, as stated before, comprising one or more positively rotating rollers arranged in appropriate places together with several yarn guides along the yarn path. The yarn winder typically includes a rotatable spindle holding a bobbin on which the yarn is wound as a package.

In recent years, the winding speed of the winder has been increased and is typically operated at a speed of about 6,000 meters per minute (m/min) or more. Such a process is disclosed, for example, in U.S. Pat. No. 4,134,882. The increased winding speed of the yarn winder is also reflected by the peripheral speed of the positive rotating rollers provided along the yarn path. This increased speed causes a particularly difficult problem in the threading operation to the positively rotating rollers by the suction nozzle.

In the suction force on the suction nozzle is that which is typical of air ejectors generally employed, the yarn cannot be drawn from the positively rotating roller having a high peripheral speed after the yarn has been introduced to the high speed roller. It is believed that this is principally due to the adhesion of the yarn to the surface of the high speed roller and/or to the accompanying air stream generated around the high speed roller by its rotation. This causes a yarn rolling-in or wrap-up on the high speed roller which in turn prevents any further threading of the yarn by the suction nozzle. The difficulty in the threading operation becomes greater as the peripheral speed on the positively rotating roller becomes higher, hence requiring an even greater suction force of the suction nozzle to draw off the yarn from the high speed roller.

Employing even the best commercially available suction nozzles under optimum conditions permits the threading of yarn having a travelling speed of at most about 3,500 to 4,000 m/min.

In Japanese Patent Publication No. 49778/72, a very high performance suction nozzle has been proposed which requires the use of a pressure chamber of very large capacity and compressed air of a very high pressure in order to maintain the high suction force. In use, however, this high performance suction nozzle has the following problems: (A) worsening of the work environment due to extremely loud noise generation upon release of the compressed air; (B) consumption of the compressed air at a great rate making continuous yarn threading operation uneconomical; (C) even the slightest drop in the suction force leads to a failure in the yarn threading operation; and (D) in the event of such failure, one must wait until the pressure recovers in the pressure-chamber before again attempting the yarn threading operation. During this wait, waste yarn is generated in great quantities.

On the other hand, for eliminating the threading operation in the doffing time, a so-called revolving type winder is utilized, which comprises a pair of spindles held on the opposite ends of a revolving arm. Each spindle is alternately displaceable from the normal winding position and the doffing position by every half a rotation of the arm. When the package is to be exchanged with an empty bobbin the arm is made to rotate a half rotation, whereby the package held on one spindle is moved to the doffing position and, simultaneously, the empty bobbin held on the other spindle is brought to the winding position. During the passage of this displacement, the yarn connected to the package is automatically transferred to the empty bobbin while keeping the yarn path as it is. However, such a winder has a very complicated structure due to the provision of mechanisms for automatically switching the yarn from the full package to the empty bobbin, such as the dual spindle, the revolving arm, or the drive thereof. This makes the manufacturing cost of the apparatus very expensive and increases the possibility of machine failure. Particularly, the vibration problem is very serious under high speed processing.

SUMMARY OF THE INVENTION

It is an object of the present invention to eliminate the above drawbacks of the prior art.

It is another object of the present invention to provide a yarn feeding means having a simple structure for easily threading a yarn to a yarn winder under a high peripheral speed of a positively rotating roller provided in a yarn path.

It is a further object of the present invention to provide a yarn winder incorporating the above yarn feeding means therein.

The above-described objects are achievable by a device for threading a yarn continuously fed from a supply source onto a positively rotating roller arranged in a yarn path between the supply source and a yarn winder for taking up the yarn. A yarn feeding means according to the invention comprises at least a positively rotating roller for receiving the yarn from the supply source and feeding the received yarn in the direction to the yarn winder by bringing the yarn into contact with a partial periphery of the positively rotating roller, and a device comprises a yarn detaching guide positioned in the vicinity of the positively rotating roller and capable of selectively occupying either of two positions. One is a first position where the detaching guide is non-operative to the yarn path and the other is a second position where the yarn detaching guide is engageable with the yarn path to detach the yarn passing thereby from the positively rotating roller.

According to another aspect of the present invention, winder for taking up a yarn continuously fed from a supply source onto a yarn package is provided. The winder comprises (a) a yarn winding means which comprises a bobbin supporting means including at least a spindle for rotatably supporting a bobbin on which a yarn package is formed, a yarn traversing means for reciprocatively guiding the yarn in the direction of the axis of the spindle, a means for rotating the bobbin, and (b) a yarn feeding means which comprises at least a positively rotating roller which is provided in a position below the yarn traversing means to receive the yarn coming down from the supply source, for receiving the yarn moving from the supply source and feeding the received yarn in the direction toward the bobbin by bringing the yarn into contact with a partial periphery of the positively rotating roller, and a yarn detaching guide capable of selectively occupying either of two positions, one being a first position where the detaching guide is non-operative to the yarn path and the other being a second position where the yarn detaching guide is engageable with the yarn path to detach the yarn passing thereby from the positively rotating roller.

Other features of the present invention will be apparent from the following description of the preferred embodiments of this invention with reference to the accompanying drawings.

BRIEF DESCRIPTION OF THE DRAWINGS

FIGS. 13A and 13B show part of a suction nozzle engaging with the carrying guide;

FIG. 14 is a similar view of another suction nozzle as shown in FIG. 13;

DESCRIPTION OF THE PREFERRED EMBODIMENTS

Figure 1:
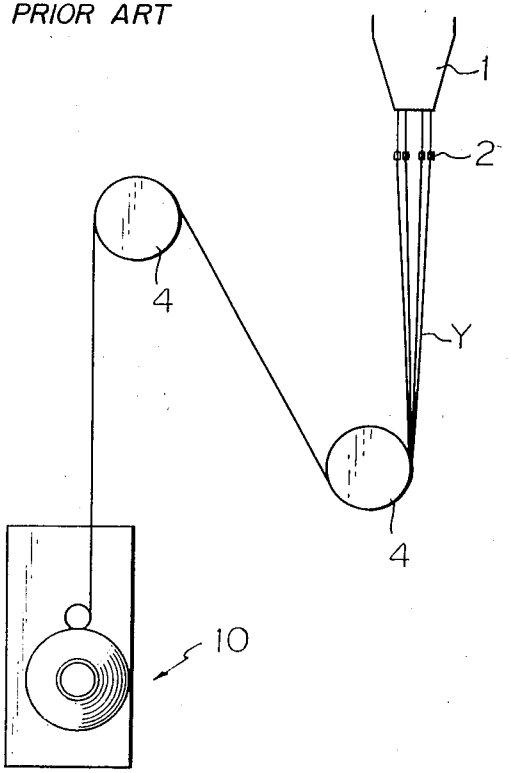
Fig. 1 PRIOR ART
FIG. 1 is a schematic front view of a take-up system for synthetic yarn, having two positively rotating rollers, which is a so-called godet roller system.
Figure 2:
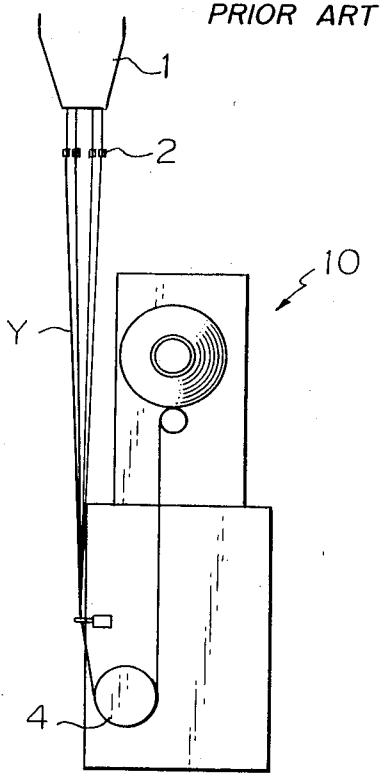
Fig. 2 PRIOR ART
FIG. 2 is a schematic front view of another take-up system for synthetic yarn, which is a so-called no-godet system.

FIGS. 1 and 2 schematically illustrate typical synthetic filamentary yarn spinning systems for which the present invention is utilized. In FIG. 1, the yarn Y fed from a supply source such as spinneret 1 is withdrawn by a take-up apparatus including a winder 10 through two positively driven feed rollers 4, 4. Reference numeral 2 designates an oiling guide by which a spinning oil is imparted to the yarn for post treatment. FIG. 2 shows an alternative system which comprises only one positively driven feed roller 4 disposed at lower part of the winder 10. This is known as a no-godet system, one example of which is described in U.S. patent application Ser. No. 575917 proposed by one of the present inventors, and can preferably cooperate with the present invention. Accordingly, hereinafter, the description will be mainly made with reference to the latter system. However, it should be understood that the present invention is not confined to this no-godet system but is applicable in a similar manner to the former conventional system.

Figure 3A:
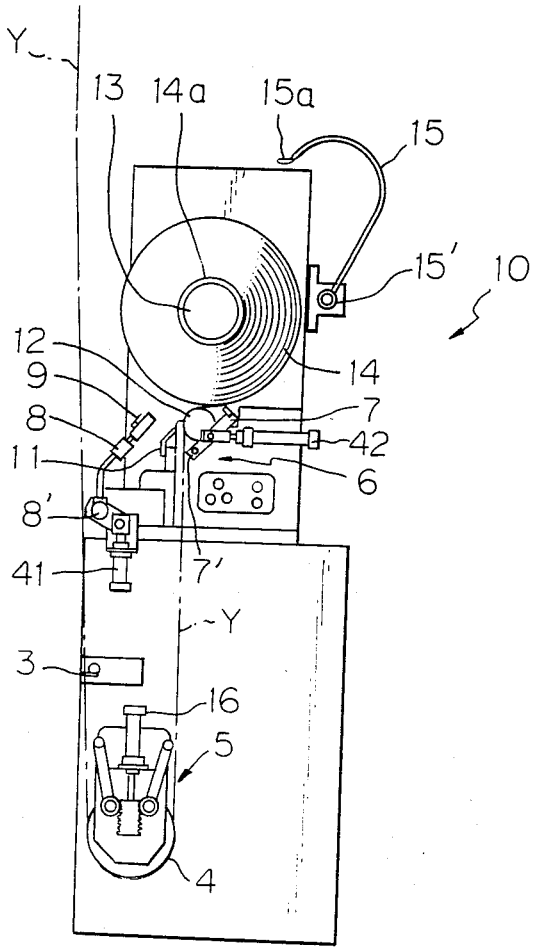
FIG. 3A is a front view of an embodiment of a yarn winder according to the present invention.
Figure 3B:
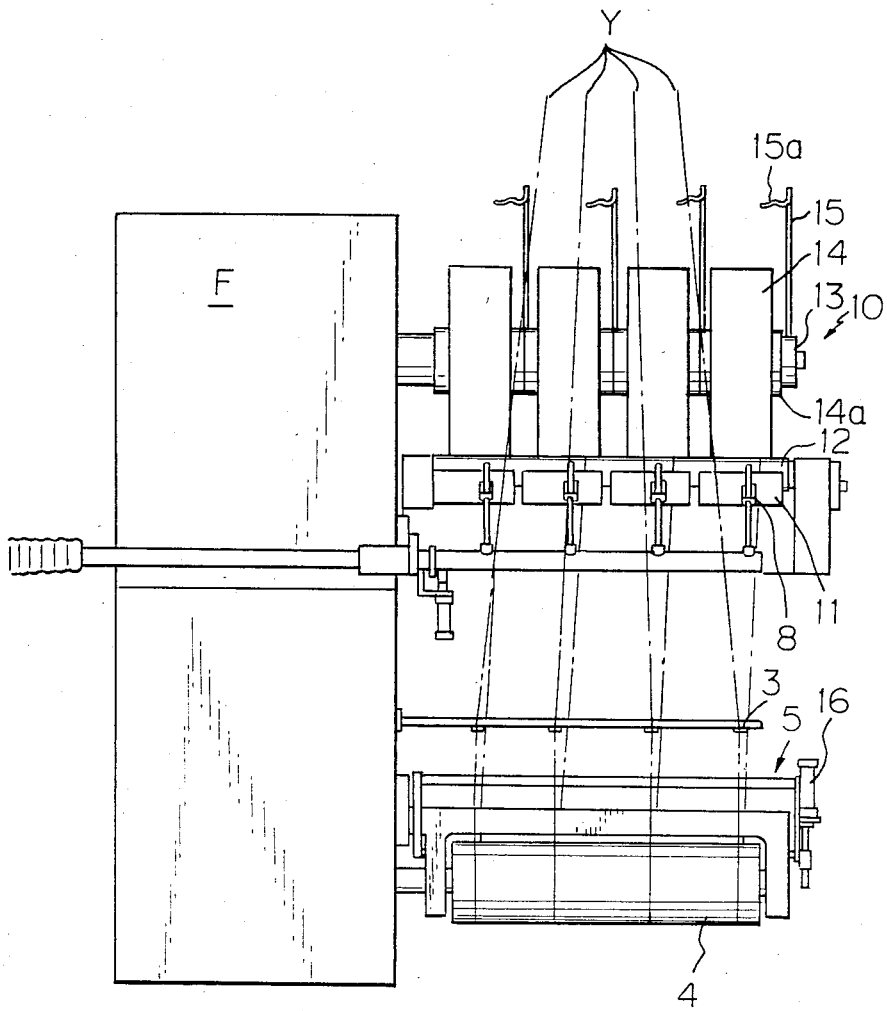
FIG. 3B is a side view of the winder shown in FIG. 3A.

FIGS. 3A and 3B show an embodiment of a take-up apparatus according to the present invention including a multi-cop winder 10, in which four yarns are taken-up to form the respective four packages simultaneously on one spindle. Although four sets of respective mechanisms for threading the yarn are provided in this apparatus, the construction and operation of only one of these mechanisms will be explained to simplify the description.

The yarn Y extruded from a spinneret 1 (FIG. 2) runs downward through an oiling guide 2 (FIG. 2), a yarn separator 3 and a positively driven feed roller 4, and then turns upward to a winder 10. The yarn Y is wound by means of the winder 10 to form a package 14 on a bobbin 14*a* held on a rotating spindle 13, while being reciprocated by a traverse motion mechanism 6 and being kept in contact with a touch roller 12 in a known manner.

The feed roller 4 is provided with a yarn detaching guide 5 which can selectively take two positions, i.e., a first (retractive) position where the guides 5 is non-operative to the yarn so that the normal winding can be carried out, and a second (projective) position where the guide 5 slidably hold the yarn so that the yarn is disengaged from the surface of the feed roller 4. A more detailed construction and operation of the detaching guide 5 will be described later.

A suction nozzle 8 for temporarily withdrawing the running yarn and a carrying guide 7 for guiding the yarn to the suction nozzle 8 are arranged between the feed roller 4 and the spindle 13. The nozzle 8 and the guide 7 are mounted on the same frame as the traverse motion mechanism 6. This frame is movable up and down, in a known manner, corresponding to a varying diameter of the package 14, so that the respective mechanisms mounted thereon can be associated with the package 14.

The suction nozzle 8 is provided with a yarn catcher 9 at a suction opening thereof and is pivotally held by a fulcrum 8' so as to be displaceable between its non-operative position remote from the package 14 and the operative position close thereto by means of a power cylinder 41 associated with the suction nozzle 8.

The carrying guide 7 is also pivotally held by a fulcrum 7' so as to be displaceable between its nonoperative and operative positions by means of another power cylinder 42 associated therewith in a similar manner as for the suction nozzle 8.

A guide plate 11 is provided between the traverse motion mechanism 6 and the suction nozzle 8 to define a yarn path for the introduction of the yarn to the suction nozzle 8 during the threading operation.

A threading guide 15 is pivotally mounted on a machine frame behind the spindle so that, when the threading guide 15 is rotated about a fulcrum 15' by means of a driving mechanism described later, a hooked member **15*a* thereof can be brought from a first (retractive) position to the proximity of the suction nozzle 8 beyond the spindle 13 or a package 14 held thereon to engage the yarn being sucked in the suction nozzle 8**.

Figure 4A:
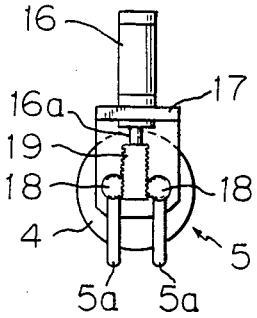
FIG. 4A is a front view of a yarn detaching guide preferably used in a yarn feeding means according to the present invention.
Figure 4B:
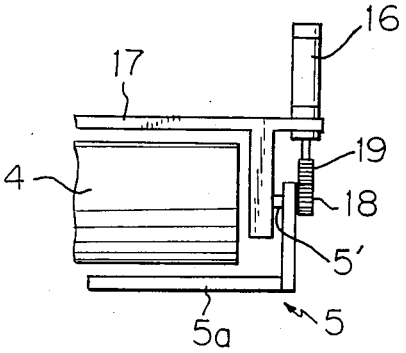
FIG. 4B is a side view of part of the yarn detaching guide shown in FIG. 4A.
Figure 6A:
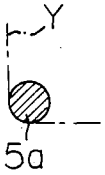
FIGS. 6A to 6D show various cross sections of the yarn detaching guide bar.
Figure 6B:
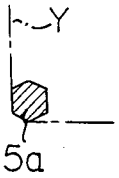
Figure 6C:
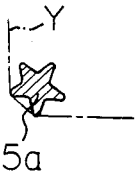
Figure 6D:
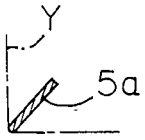
Figures 5A, 5B, 5C, 5D:
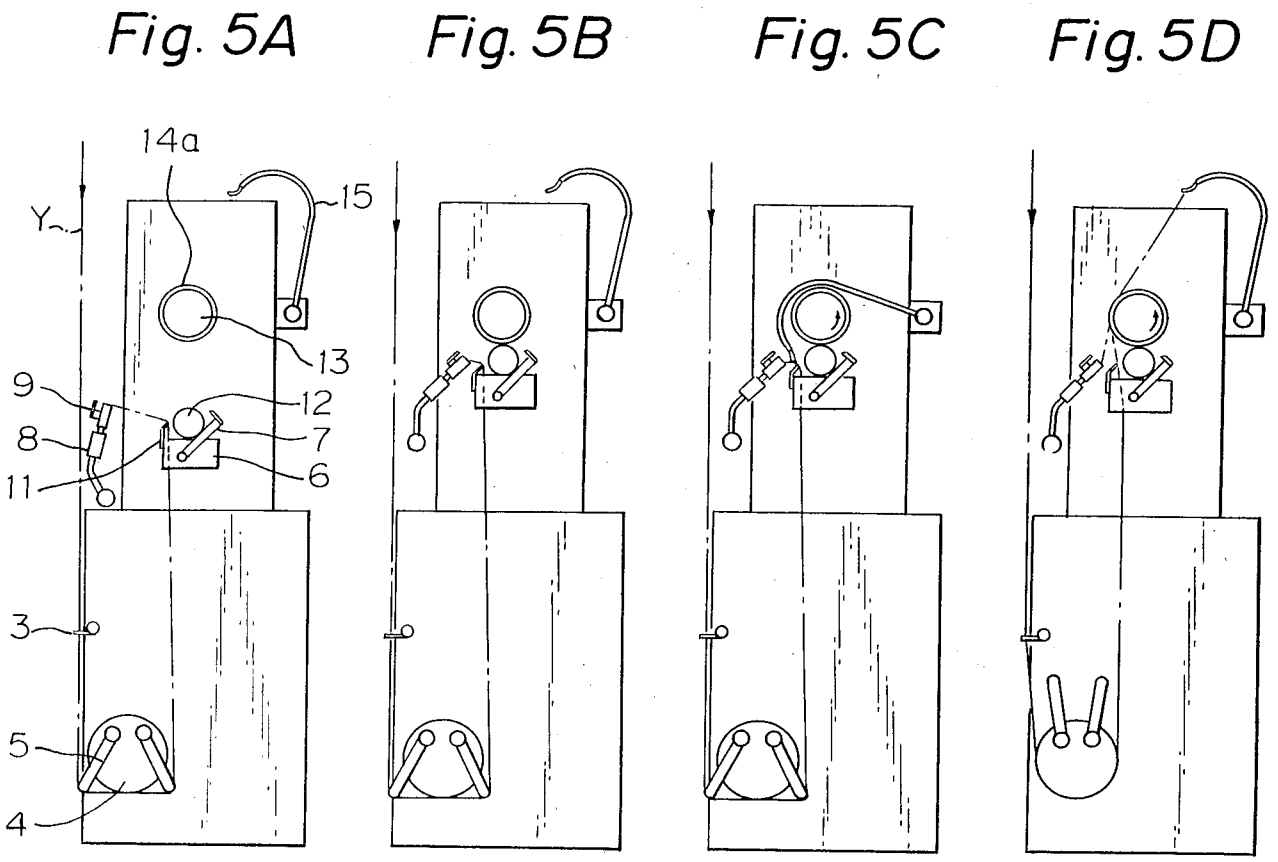
FIGS. 5A to 5D are schematic front views of the winder showing sequential steps of the threading operation.

The construction of the yarn detaching guide 5 is now explained with reference to FIGS. 4A and 4B. The yarn detaching guide 5 comprises a pair of bars **5*a*, 5*a* extending parallel to the axis of the feed roller 4. A pair of studs 5', 5' are rotatably secured on the opposite side walls of a bracket 17 by means of bearings (not shown) and hold the respective bars 5*a*, 5*a* so as to be rotatable therewith. The bracket 17 is disposed in a position close to the feed roller 4 in such a manner that it does not interfere with the path of the running yarn. Each of the studs 5', 5' has a gear 18 at the outer end thereof. A rack 19 provided with teeth on both sides thereof is engaged between the pair of gears 18, 18. The rack 19 is fixed to an actuator 16*a* of a power cylinder 16 also secured on the bracket 17 so that the rack 19 can move up and down while being engaged with the gears 18, 18. The upward motion of the rack 19 from the position shown in FIG. 4A causes a clockwise rotation of the right hand gear 18 and a counterclockwise rotation of the left hand gear 18, thereby bringing the bars 5*a*, 5*a* to the projective position as shown in FIG. 5B**.

The bar **5*a* may be of any cross sectional shape, such as a circle, polygon, star, or blade, as shown in FIGS. 6A to 6D. The bar 5*a* may be of a material such as usually utilized for a yarn guide, for example, ceramics or satin-finished steel with a hard chromium plating. That is, the bar 5*a*** must have a low frictional coefficient relative to the yarn as well as a good durability against abrasion.

Figure 7:
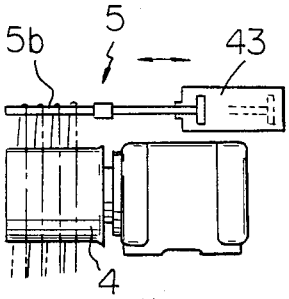
FIG. 7 is a side view of another yarn detaching guide preferably used in a yarn feeding means according to the present invention.

Another embodiment of the yarn detaching guide 5 is illustrated in FIG. 7. According to this embodiment, the bar **5*b* corresponding to bar 5*a* in FIGS. 4*a* and 4*b*, can be displaced parallel to the axis of the feed roller 4 by a power cylinder 43, e.g., from its retractive position to the projective position. During the threading operation, the yarn Y is detached from the feed roller 4** as shown in the drawing.

Figure 8:
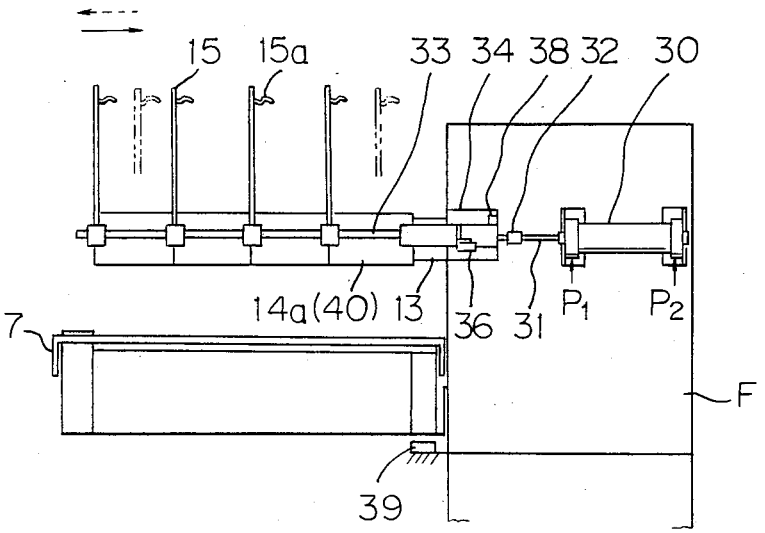
FIG. 8 is a side view of the winder according to the present invention, mainly showing a driving means of a threading guide.
Figure 9:
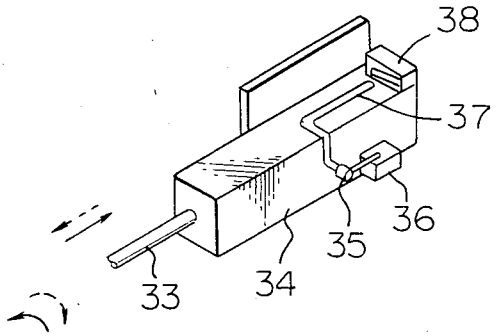
FIG. 9 is a perspective view of part of the driving means of the threading guide shown in FIG. 8.

A mechanism for actuating the threading guide 15 is described with reference to FIGS. 8 and 9. The threading guide 15 is secured on a rod 33 rigidly connected by means of a coupling means 32 to an actuator 31 of a power cylinder 30 mounted on a machine frame F. A root portion of the rod 33 is supported slidably and rotatably in a housing 34 also fixedly mounted on the frame F. The power cylinder 30 is of a type capable of sequential axial stroke and rotation about its axis, one example thereof being provided by THK K.K. (Japan) under the name of RD-type. To detect the position of the threading guide 15 for the purpose of sequential control, a dog 35 is fixed on the surface of the rod 33 and is engaged with a curved slot 37 provided through the wall of the housing 34. The slot 37 is formed so that the dog 35 can be movable therealong, corresponding to the movement of the rod 33. Accordingly, the dog 35 can be a measure of the position of the threading guide 15. Two limit positions are detected by the engagement of the dog 35 with limit switches 36 and 38 as described later. When air is supplied to a port $P_1$ of the power cylinder 30 at the initial stage shown in FIGS. 8 and 9, the rod 33 rotates in the direction shown by a solid line arrow, and then moves axially as shown by the other solid line arrow. Next, when air is supplied to a port $P_2$ of the power cylinder 30, the rod 33 moves back axially and, thereafter returns to the initial position, as shown by the dotted line arrows. Corresponding to these movements of the rod 33, the threading guide 15 can be displaced between its non-operative position and the operative position.

Now, the threading operation will be explained with reference to FIGS. 5A to 5D and FIG. 10 for initiating the take-up of the yarn on a fresh bobbin. The drawings are schematic illustrations of the apparatus according to the present invention, and are only for explanation purposes.

By operating a push button 21 (FIG. 10) for initiation of the winding operation, the yarn detaching guide 5 is actuated to take the projective position and the feed roller 4 begins to rotate at a normal speed. At the same time, the suction nozzle 8 also starts sucking. The yarn Y delivered from the spinneret 1 (FIG. 2) is sequentially guided to the yarn separater 3 and the yarn detaching guide 5 while being continuously withdrawn in the suction gun held by the operator, and, finally, is transferred to the suction nozzle 8 via the guide plate 11, which operation will be explained later in more detail. This state is shown in FIG. 5A.

When a push button 24 is operated, the traverse motion mechanism 6 rises together with the suction nozzle 8, whereby the touch roller 12 is brought into contact with the bobbin **14*a* held on the spindle 13. Simultaneously with the above operation, the suction nozzle 8 is displaced to its operative position as shown in FIG. 5B. The spindle 13 is then made to rotate by operating a push button 22**.

When a signal is received that the rotational speed of the bobbin **14*a* has reached the preset value, a command signal is output to a control valve (not shown) of the power cylinder 30 (FIG. 8) for actuating the threading guide 15, whereby the threading guide 15 is made to rotate beyond the bobbin 14*a* and then moves along the axis of the bobbin 14*a*, as stated before. According to this displacement of the threading guide 15, the yarn Y being sucked into the suction nozzle 8 is caught by the hooked member 15*a* (FIG. 8) of the former. The displacement of the threading guide 15 causes the limit switch 38 (FIGS. 8 and 9) to operate and the power cylinder 30 (FIG. 8) moves the threading guide 15 back along the axis of the bobbin 14*a*** in accordance with the first half of its returning motion.

Figure 16:
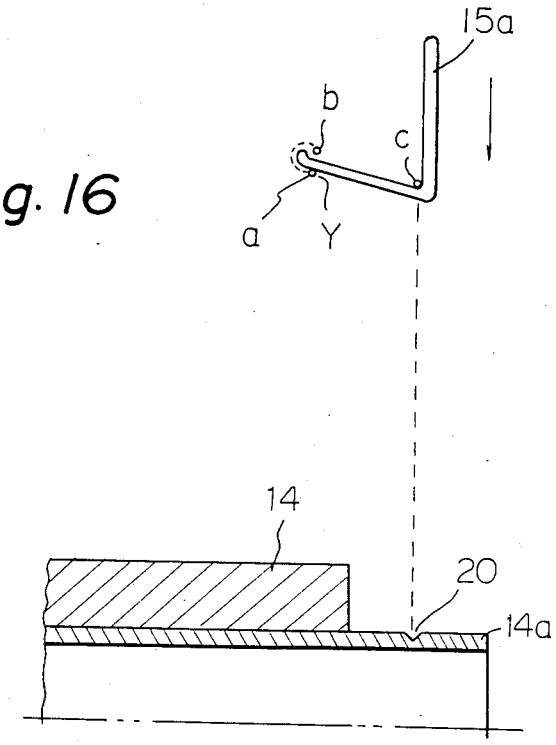
FIG. 16 shows displacement of a yarn caught by the threading guide in relation to a package.

Thereafter, the power cylinder 30 (FIG. 8) reversely rotates the threading guide 15 to the original non-operative position in accordance with the latter half of its returning motion, whereby the yarn is engaged and transferred to a yarn catching groove 20 (FIG. 16) provided on an edge portion of the bobbin 14*a*. At this stage, the limit switch 36 (FIG. 8) is operated to return the yarn detaching guide 5 to its retractive position, as shown in FIG. 5D. Thus, the normal winding operation can start with a preset take-up speed, and thereafter, the suction nozzle 8 is moved back to its non-operative position and discontinues the sucking operation.

An operation for switching the yarn from the package to the empty bobbin will be described below with reference to FIGS. 11A to 11D utilizing the apparatus according to the present invention.

Figure 10:
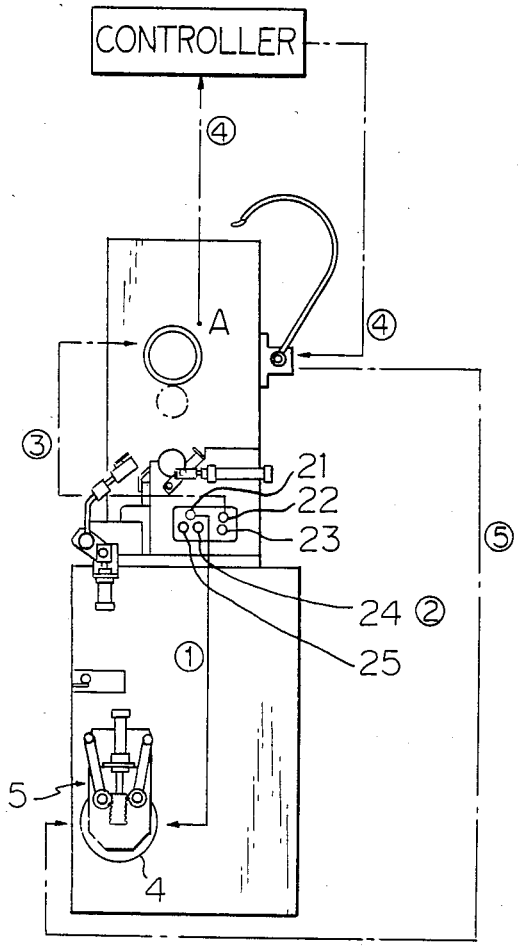
FIG. 10 is a schematic front view of the winder showing a control system of the threading operation illustrated in FIGS. 5A to 5D.
Figure 12:
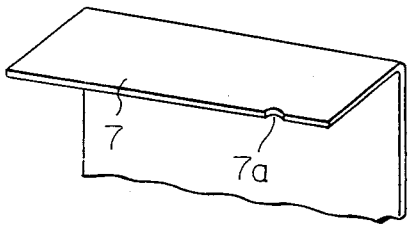
FIG. 12 is a perspective view of part of a carrying guide preferably utilized in the winder according to the present invention.
Figure 11D:
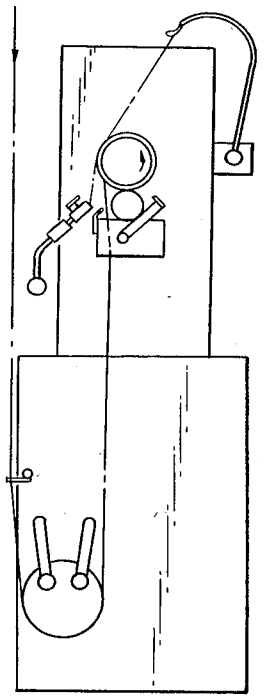
FIGS. 11A to 11D are schematic front views of the winder showing sequential steps of the yarn switching operation.
Figure 11C:
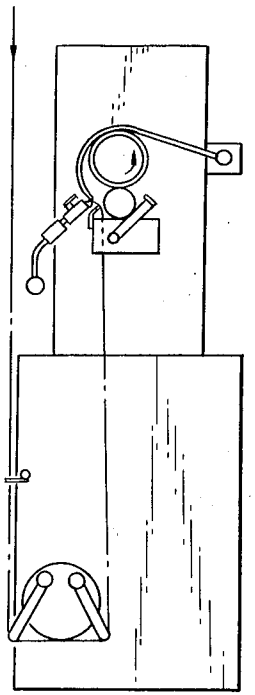
Figure 11B:
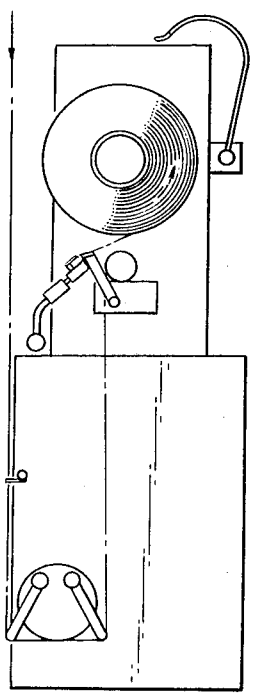
Figure 11A:
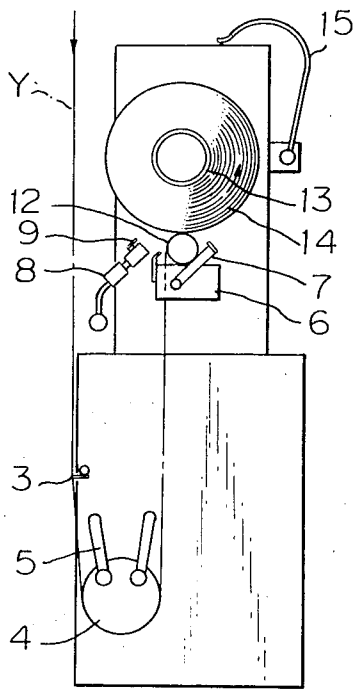

FIG. 11A illustrates a normal winding state of the apparatus. When the package 14 reaches the predetermined size or is required to be doffed for some reason, a signal is generated automatically by means of a known device (not shown) in the former case or by manually pushing a push button 23 (FIG. 10) in the latter case. According to this signal, the frame on which the traverse motion mechanism 6 is mounted is lowered to detach the touch roller 12 from the package 14. The suction nozzle 8 then moves to its operative position and commences the suction. Simultaneously therewith, the yarn detaching guide 5 moves to the projective position so as to detach the yarn from the feed roller 4. According to a signal generated from a limit switch 39 (FIG. 8) indicating that the frame of the traverse motion mechanism 6 has reached the lowermost position, the carrying guide 7 moves to its operative position so that the yarn being wound on the package 14 is nipped between the former and the yarn catcher 9 provided on the suction nozzle 8, as shown in FIG. 11B, whereby the upstream side of the yarn Y is sucked into the suction nozzle 8. To facilitate the introduction of the yarn to the suction nozzle 8, the following means are provided:

As shown in FIG. 12, a yarn catching dent 7*a* is provided on the top end of the carrying guide 7 at a position aligned with the suction nozzle 8 for surely guiding the yarn into the latter.

FIGS. 13A, 13B and 14 respectively illustrate enlarged views of two embodiments of the suction nozzle 8 utilized in the present invention. In FIGS. 13A and 13B, the suction nozzle 8 has a yarn catcher 9 comprising a pair of blades 9*a*, 9*a* made from a resilient material at a side wall remote from the carrying guide 7. The running yarn Y guided by the carrying guide 7 is pushed into and between the two blades 9*a*, 9*a* and is held therein. While, a slot 8*a* is provided on a wall of the suction opening of the suction nozzle 8, along the yarn path, so that the yarn can be smoothly sucked into the suction nozzle 8.

Since the yarn Y is nipped in such a manner that it makes an acute angle with the carrying guide 7 by cooperation of the yarn catcher 9, the yarn Y can easily be torn in the upstream region. an alternative suction nozzle 8 shown in FIG. 14 has a knife or a heater 10 in place of the yarn catcher 9 for positively severing the yarn. In this case, to facilitate the introduction of the yarn to the suction nozzle 8, the yarn tension in the upstream region is preferably lowered by braking the spindle 13 so that a yarn portion can be preliminarily sucked into the suction nozzle 8 before the carrying guide 7 operates to nip the yarn.

Figure 15A:
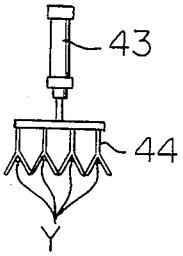
FIG. 15A is a plan view of a movable guide for detaching a yarn from an oiling guide.
Figure 15B:
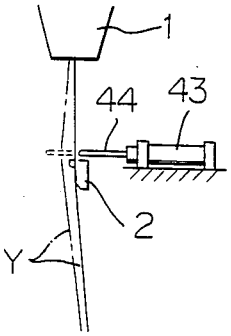
FIG. 15B is a side view of the movable guide shown in FIG. 15A.

An additional means may be provided to assist the introduction of the yarn into the suction nozzle 8 for protecting the yarn from the effect of the oiling guide 2. As shown in FIGS. 15A and 15B, this means comprises a power cylinder 43 and a movable guide 44 connected thereto and is disposed just upstream of the oiling guide 2. Synchronously with the operation of the carrying guide 7, the movable guide 44 moves to detach the yarn Y from the oiling guide 2 by means of the power cylinder 43, whereby the jamming of the yarn at the oiling guide 2 can be avoided even if the yarn tempararily slackens during the nipping operation of the carrying guide 7.

Now, referring to FIG. 11B again, the downstream portion of the yarn in relation to the suction nozzle 8 is severed due to the increased tension caused by the yarn nipping of the carrying guide 7.

After the predetermined time delay preset by a timer, the carrying guide 7 returns to its retractive position. While, the rotation of the package 14 is stopped by means of a brake (not shown).

While the yarn is continuously being withdrawn by the suction nozzle 8, the package 14 is doffed and, instead, the fresh bobbin 14*a* is inserted to the spindle 13.

By operating the push button 24 (FIG. 10), the traverse motion mechanism 6 rises along with the touch roller 12 and the latter is brought into contact with the bobbin 14*a*. Thereafter, the spindle 13 is rotated by the operation of the push button 22 (FIG. 10). As shown in FIG. 11C, when the rotational speed of the bobbin 14*a* has reached a preset value, a signal is generated to operate the threading guide 15 by which the yarn held and sucked by the suction nozzle 8 is caught in the same manner as stated before with reference to FIG. 5C. The threading guide 15 then returns to its retractive position as shown in FIG. 11D and the yarn is wound on the bobbin 14*a* in the same manner as stated before with reference to FIG. 5D. Thus, the yarn switching operation from the full package to the empty bobbin is completed.

In the above description, the threading guide 15 is displaced, after the engagement with the yarn, in the axial direction of the bobbin 14*a*, so that the yarn is aligned with the yarn catching groove 20 of the bobbin 14*a*, and is then rotated so that the yarn is engaged with the groove 20. This complicated movement of the threading guide can be omitted by using the hooked member 15*a* shown in FIG. 16. That is, the hooked member 15*a* may have a slanting portion with an inwardly curved tip, by which the yarn Y positioned in the suction nozzle 8 (this positon is designated as a) is at first guided to a position b due to a displacement of the threading guide 15 in the direction shown by arrow and then to a further position c corresponding to the yarn catching groove 20 of the bobbin 14*a* by the upward movement of the threading guide 15.

The present invention can be applied not only to the above-described type winder for forming a cross-wind cheese, but also to one for forming a pirn having a tapered shoulder by a slow traverse motion.

Further, the present invention can be applied to a surface drive type winder in which the spindle is passively rotated by a fricton roller.

According to the above features, the winder of the present invention results in the following advantages:

(i) Since the feed roller is disposed beneath the winder, vibration of the yarn caused by the reciprocating operation of the traverse motion mechanism is prevented from ascending to the upstream region near the spinneret, where the yarn is not yet completely solidified, whereby the production of uneven yarn can be avoided. Further, the control of the winding tension can be easily achieved.

(ii) Due to the provision of the yarn detaching guide, the yarn extruded from the spinneret can be sucked into the suction gun as it is delivered, irrespective of the surface speed of the feed roller. Therefore, even a suction gun with a standard performance can be utilized for a high speed take-up exceeding 6,000 m/min.

(iii) Provision of the suction nozzle between the feed roller and the spindle of the winder as well as the threading guide enables the automatic threading to the empty bobbin to be carried out with the cooperation of the detaching guide.

(iv) Provision of the carrying guide adjacent to the suction nozzle enables the automatic yarn switching from the package to the empty bobbin to be carried out with the cooperation of the detaching guide during the high speed take-up. That is, compared to the conventional winder, in which the success rate of the yarn switching operation decreases as the take-up speed increases, the winder of the present invention can attain a high operation success rate irrespective of the take-up speed.

(v) Since the winder of the present invention is provided with only one spindle, the construction is very simple compared to the conventional revolving type winder having two spindles and, therefore, the manufacturing cost is reduced and the vibration problem involved in the high speed winding can be avoided.

We claim:

1. A yarn winder for taking up a yarn continuously fed from a supply source onto a yarn package, comprising (a) a yarn winding means which comprises (a-1) a bobbin supporting means including at least a spindle for rotatably supporting a bobbin on which a yarn package is formed, (a-2) a yarn traversing means for reciprocatingly guiding the yarn in the direction of the axis of said spindle, (a-3) a means for rotating the bobbin, and (b) a yarn feeding means which comprises (b-1) at least a positively rotating feed roller for receiving the yarn moving from said supply source and feeding the received yarn in the direction toward the bobbin by bringing the yarn into contact with a partial periphery of said feed roller;

said feed roller being provided in a position below said yarn traversing means to receive the yarn coming down from said supply source, and (b-2) a yarn detaching guide positioned in the vicinity of said feed roller and capable of selectively occupying either of two positions, one being a first position where said yarn detaching guide is disengageable from the yarn causing the yarn to pass around said feed roller while touching at least a part of the periphery of said feed roller and the other being a second position where said yarn detaching guide is engageable with the yarn to competely detach the yarn passing thereby from said feed roller.

2. A yarn winder according to claim 1, wherein said bobbin supporting means has a single spindle.

3. A yarn winder according to claim 1, further comprising:

a touch roller disposed parallel to the axis of said spindle and detachably engageable with the yarn package being wound on the bobbin held on said spindle.

4. A yarn winder according to claim 3, wherein said touch roller is arranged in a region beneath a horizontal plane including the axis of said spindle.

5. A yarn winder according to claim 1, wherein said spindle is of a multi-cop type.

6. A yarn winder according to claim 1, further comprising:

(a) a suction means, which comprises at least a suction nozzle having suction opening disposed between said feed roller and said yarn winding means, for temporarily withdrawing the yarn fed from said supply source, said suction nozzle being capable of selectively occupying either of two positions, one being a first position remote from the yarn and the other being a second position in the vicinity of the yarn, and (b) a threading guide for transferring the yarn being withdrawn into said suction opening of said suction nozzle therefrom to the bobbin driven by said bobbin rotating means, said threading guide being displaceable between two positions, one being a first position remote from the yarn and the other being a second position in the vicinity of the second position of said suction nozzle, in said second position said threading guide being capable of catching the yarn being withdrawn in the suction opening of said sunction nozzle.

7. A yarn winder according to claim 6, further comprising:

a carrying guide, disposed between said feed roller and said yarn winding means, for introducing the yarn fed from the supply source and being wound on the package to said suction nozzle and for severing the yarn portion adjacent to the package so that the yarn is withdrawn into said suction nozzle, said carrying guide being displaceable between two positions, one being a first position remote from the yarn and the other being a second position in the vicinity of the second position of said suction nozzle, during the displacement from the first position to the second, said carrying guide being engageable with the yarn being wound on the package.

8. A yarn winder according to claim 7, wherein said suction nozzle is provided with a yarn catching means which is engageable with a front edge of said carrying guide so that the yarn is nipped therebetween.

9. A yarn winder according to claim 8, wherein said yarn catching means is a pair of blades.

10. A yarn winder according to claim 8, wherein said yarn catching means is a heater.

11. A yarn winder according to claim 8, wherein said yarn catching means is a knife.

12. A yarn winder according to claim 7, further comprising:

an oiling guide for oiling said yarn, upstream of said carrying guide;

a movable guide for detaching the yarn from said oiling guide disposed upstream of said oiling guide and movable synchronously with said carrying guide; and means for moving said movable guide synchronously with said carrying guide.

* * * * *